United States Patent [19]

Dove

[11] 4,101,052

[45] Jul. 18, 1978

[54] CONTAINERS FOR TRANSFERRING MERCHANDISE BETWEEN DISTRIBUTION SERVICE CENTERS AND RETAIL STORES, WHILE SECURITY SEALED IN EITHER AN EXPANDED OR A REDUCED VOLUME CONFIGURATION

[75] Inventor: Douglas J. A. Dove, Edmonds, Wash.

[73] Assignee: Interstore Transfer Specialists, Inc., Edmonds, Wash.

[21] Appl. No.: 774,323

[22] Filed: Mar. 4, 1977

[51] Int. Cl.[2] ..... B65D 5/35

[52] U.S. Cl. ..... 229/23 R; 229/41 R; 229/45 R; 229/52 B

[58] Field of Search ..... 229/41 R, 41 B, 23 R, 229/23 BT, 34 R, 34 B, 52 B, 14 BA, 45 R

[56] References Cited

U.S. PATENT DOCUMENTS

| | | | |
|---|---|---|---|
| 2,103,373 | 12/1937 | McClure | 229/52 B |
| 2,340,394 | 2/1944 | Limbert et al. | 229/52 B |
| 3,438,562 | 4/1969 | Connor et al. | 229/41 R |
| 3,815,808 | 6/1974 | Bunnell | 229/52 B |
| 3,917,154 | 11/1975 | Dove | 229/14 BA |

FOREIGN PATENT DOCUMENTS

| | | | |
|---|---|---|---|
| 386,103 | 1/1933 | United Kingdom | 229/52 B |

*Primary Examiner*—William Price
*Assistant Examiner*—Allan N. Shoap
*Attorney, Agent, or Firm*—Roy E. Mattern, Jr.

[57] ABSTRACT

Modifications are made to earlier like purpose containers, set forth in U.S. Pat. Nos. 3,438,562 and 3,917,154, to fill the commercial requirement for such containers which will perform some of the functions in a less demanding way at a lower cost. These modified containers are likewise used to transfer merchandise between distribution service centers and retail stores, while security sealed in either an expanded or a reduced volume configuration. The principal modification centers on making, from an original one piece planar structure and keeping them together as one handling unit, both the functioning components, of the bottom with its side walls, and the liner, which together double the strength of the effective overall side structures of the containers, but not the shorter end structures.

20 Claims, 10 Drawing Figures

FIG. 1
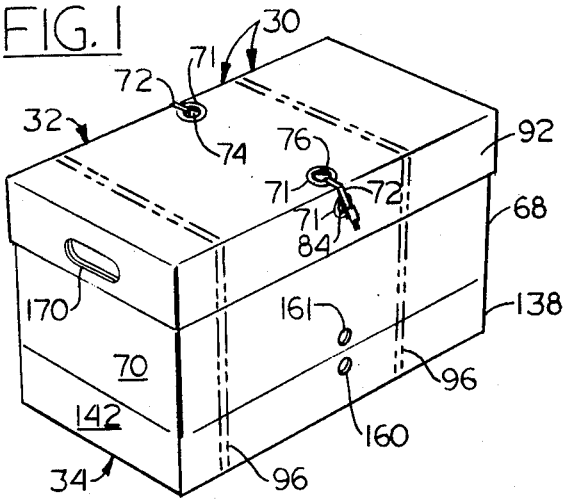
FIG. 2
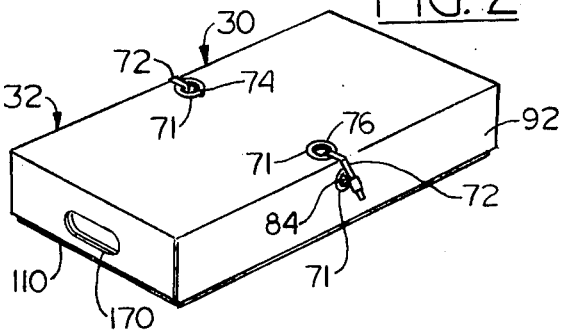
FIG. 3
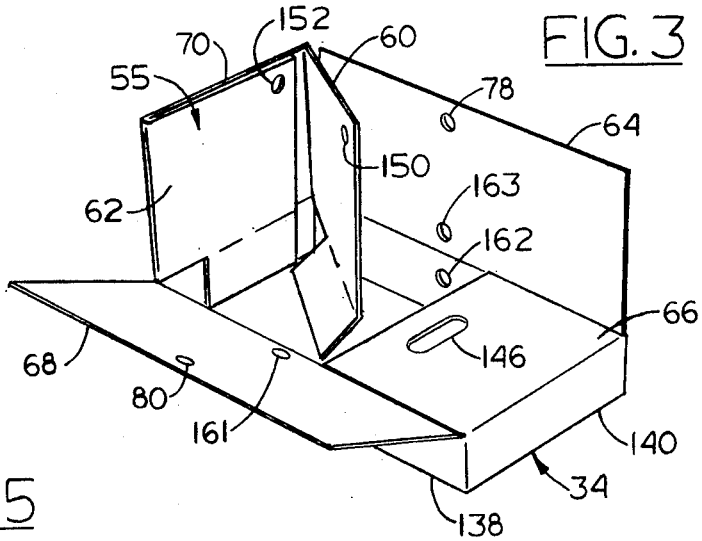
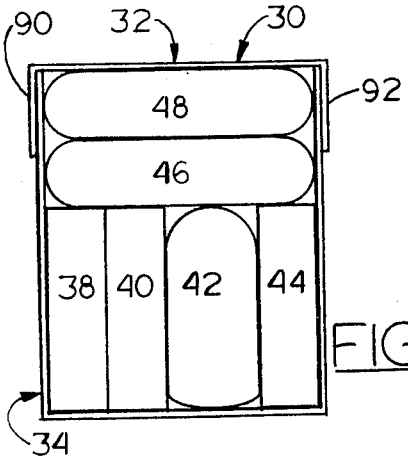
FIG. 5
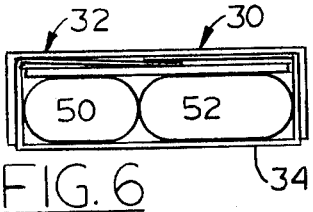
FIG. 6
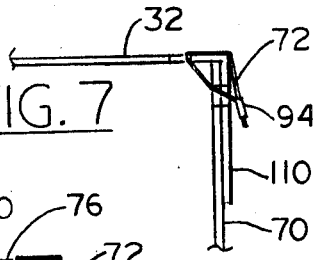
FIG. 7
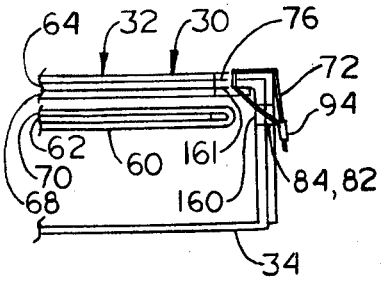
FIG. 8
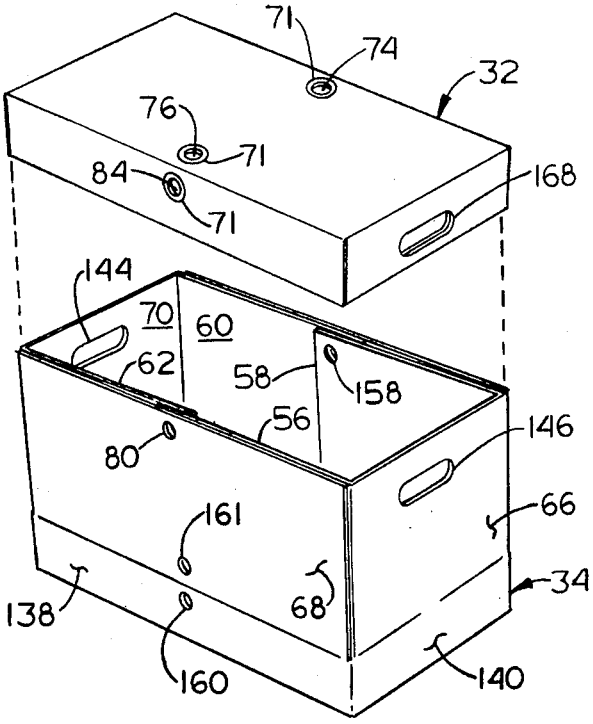
FIG. 4

CONTAINERS FOR TRANSFERRING MERCHANDISE BETWEEN DISTRIBUTION SERVICE CENTERS AND RETAIL STORES, WHILE SECURITY SEALED IN EITHER AN EXPANDED OR A REDUCED VOLUME CONFIGURATION

CROSS REFERENCE TO RELATED PATENTS

Reference is made to U.S. Pat. Nos. 3,438,562 and 3,917,154.

BACKGROUND OF THE INVENTION

As set forth in the earlier patents U.S. Pat. Nos. 3,438,562 and 3,917,154 every person concerned with shipping transferring goods between shipping and receiving locations is concerned with their safe arrival in excellent condition at the lowest possible cost and convenience, when all factors are to be considered. The containers set forth in these patents, especially as improved and described in the latter patent, have met the requirements of persons who are so concerned. However, there have been requests from some of these persons for a container offering many of the same advantages, yet being made at a lower cost, to be used where the type of handling and/or the continued period of handling does not require all of the strength and wear resistant advantages of the other higher cost containers. To fulfill these requests these containers have been provided wherein the liner is manufactured from the original one piece planar structure from which the bottom with its sidewalls are likewise derived, and the liner remains with the bottom during the use and reuse of the container.

SUMMARY OF THE INVENTION

As set forth in U.S. Pat. No. 3,917,154, when all factors are considered in handling, shipping, and transferring valuable goods such as merchandise and documents, reusable, multiple trip containers are found to be the best. This is especially true in transferring merchandise between department store service centers and respective retail stores, and in like or somewhat similar distribution patterns, when the containers are arranged either in an expanded or reduced volume configuration, while security sealed and coded with a coded accountability transfer document enclosed.

The containers first illustrated and described in U.S. Pat. No. 3,438,562 and containers especially as illustrated and improved in U.S. Pat. No. 3,917,154, fulfilled the stringent requirements established by users, shippers and other persons who required a very high degree of security and accountability and maximum strength and durability. However, at times, persons concerned with providing containers fulfilling these stringent requirements, have indicated that although many of the features are still wanted, there are operational requirements to be fulfilled which are less stringent, and perhaps therefore a container could be supplied at a lower cost. To meet these requests, modifications have been made to create a new embodiment of these interstore containers which meets the lower cost demand for such an expandable volume security container, yet it is provided to meet the still high, but less stringent, requirements of structural integrity and protection against pilferage.

In this more economical container, the liner and the bottom with its side walls are both made from the original one piece planar structure and they so remain together as one handling unit throughout the useful life of the overall container. As before in the earlier embodiments of the containers, in this embodiment the sidewalls and the liner, now integral, together double the strength of the effective overall side structures but not the shorter end structures of the container.

The illustrated embodiment uses the antitear strips set forth in U.S. Pat. No. 3,917,154 to increase the resistance both to rough handling and also to attempted security seal interference. Moreover, this embodiment may include provisions to be sealed by holding straps and by loop seals.

Likewise as before in conjunction with the earlier embodiments, this lower cost embodiment of these shipping and transfer containers is sealable while being used in either an expanded or reduced volume configuration to protect valuable goods, provide the user with many benefits with the most efficient utilization of material and most economical cost per container. For example, this low cost shipping and transfer container gives the customer and user: coded and accountable sealed security in one of two selectable volumes; extended periods of reusability while remaining clean inside; space saving collapsibility for smaller shipments and storage; reduced labor requirements in packaging and handling; size range options of different embodiments; maximum use of vehicle cargo spaces; lightweight handling conveniences; utilization of standard tooling and equipment; and realization of savings as losses caused by pilferage and damage are substantially reduced often becoming very minimal.

THE DRAWINGS OF THE PREFERRED EMBODIMENT

The figures of the drawings illustrate how this preferred lower cost embodiment of the invention is utilized to further benefit the users. These persons are shipping and transferring valuable merchandise to and from merchandise distribution centers and retail stores in either the expanded or the reduced volume configurations of these transfer containers, sometimes also referred to as interstore transfer containers. In so using these containers, these persons prepare the shipment by security coding and sealing the containers and by including coded transfer documents, either placed inside and/or outside in protective pockets. These documents account for the contents packed, sent, and to be received.

FIG. 1 is a perspective view of this shipping and transfer container, often referred to as in interstore transfer container, in its expanded volume configuration and sealed upon the securement of two like coded loopable security seals or by sealed straps shown in phantom lines, indicating the finger gripping places at each end;

FIG. 2 is a perspective view to illustrate this shipping and transfer container, in its reduced volume configuration with loopable coded security seals;

FIG. 3 is a perspective view to illustrate how the now combined integral partial liner and the volume changing pivotal flaps of the bottom are folded and unfolded in creating the expanded volume configuration of this shipping and transfer container;

FIG. 4 is a perspective view to illustrate how the top subassembly is placed over the bottom subassembly of the container assembly when in the expanded volume configuration and indicating how double walls are created along the sides, and also indicating the placement of receiving means for the loopable seals, and the finger gripping means;

FIG. 5 is a sectional view of this shipping and transfer container taken just beyond its sealed location showing its expanded volume configuration filled with items of merchandise;

FIG. 6 is a sectional view of this shipping and transfer container taken just beyond its sealed location showing its reduced volume configuration filled with merchandise;

FIG. 7 is a partial sectional view illustrating the loopable seal and the seal receiving means when the container assembly is in its expanded volume configuration;

FIG. 8 is a partial sectional view illustrating the loopable seal and the seal receiving means when the container assembly is in its reduced volume configuration;

Figure 9:
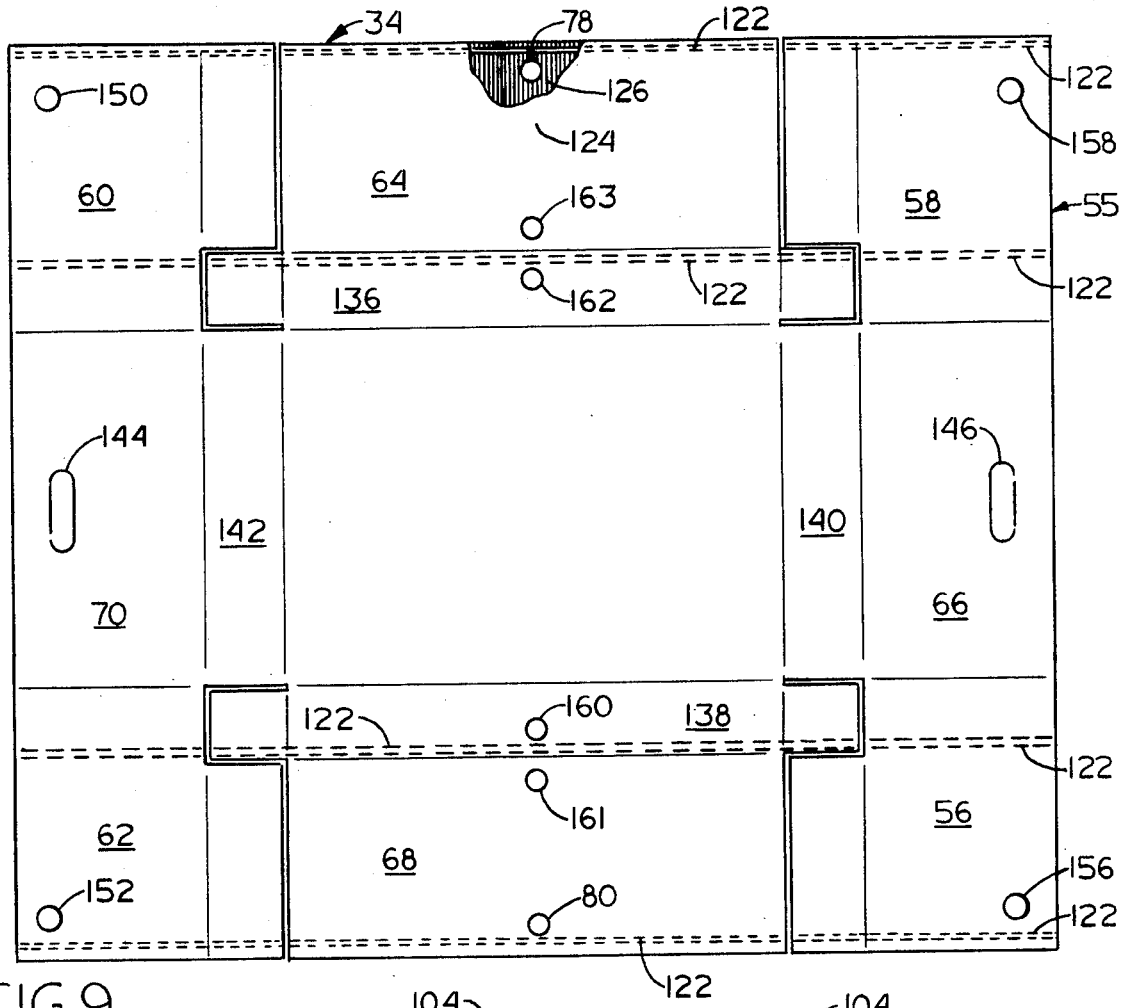
Figure 10:
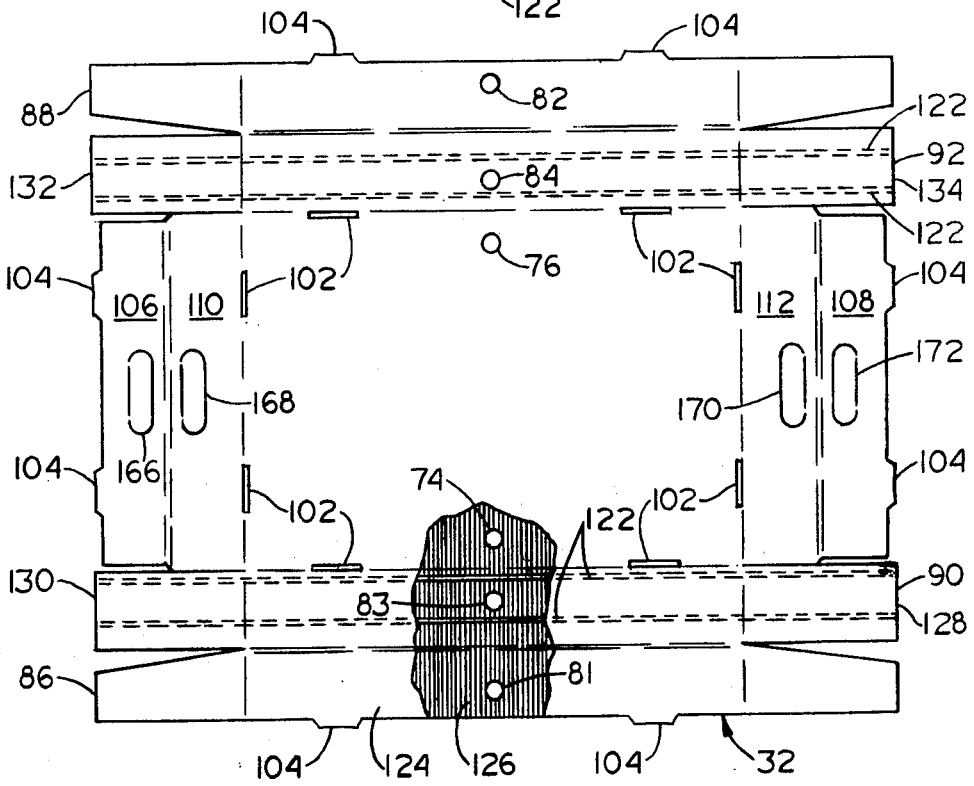

FIG. 9 illustrates, in planar form the integral bottom subassembly, after manufacturing, indicating the volume changing pivotal flaps and partial liner, and also the placement of the reinforcing antitear tapes of nylon filaments, shown by the dotted lines, to offer resistance to rough handling and attempted security seal interference; and FIG. 10 illustrates, in planar form, the integral top subassembly, after manufacturing, indicating the placement of the reinforcing antitear tapes of nylon filaments, shown by the dotted lines, to offer resistance to rough handling and attempted security seal interference, and also indicating the finger gripping means at each end of the cover which align with the finger gripping means of the volume changing flaps.

DESCRIPTION OF THE PREFERRED EMBODIMENT

Introduction

This lower cost shipping and transfer container is made to be repeatedly used under less stringent conditions throughout an extended operating time, while always keeping the contents being shipped and transferred, clean, undamaged and well accounted for through the utilization of tamper proof seals and coded documents, the original or copy of which is normally placed within the sealed container or within a protective covering on the outside of the container. In so doing, the overall cost considerations are kept even competitively lower, when full and thorough comparisons are undertaken and properly analyzed. The customer and user selecting and utilizing embodiments of this shipping and transfer container assembly receive the following benefits; coded and accountable sealed security in one of two selectable volumes; extended periods of reusability while remaining clean inside; space saving collapsibility for smaller shipments and storage; reduced labor requirements in packaging and handling; size range options of different embodiments; maximum use of vehicle cargo spaces; lightweight handling conveniences; utilization of standard tooling and equipment; and realization of savings as losses caused by pilferage and damage are substantially reduced often becoming very minimal.

How the Shipping-Transfer Container is Used

In FIGS. 1 through 8 an embodiment of the invention is shown which is used in the shipping-transfers of merchandise from a distribution service center to retail stores and between retail stores. The container assembly 30 is illustrated in FIG. 2 in its reduced volume configuration occupying a reasonable minimum amount of space. As indicated in FIGS. 5 and 6, the top subassembly 32 and the bottom subassembly 34 of the changeable volume container 30, are always closely fitted together. In FIG. 6 in the reduced volume configuration, within the bottom subassembly 34, the volume changing pivotal flaps and the integral partial liner are folded awaiting use when container assembly 30 is rearranged quickly into its expanded volume configuration shown in FIGS. 1, 3, 4 and 5.

When the container assembly 30 is expanded, as illustrated in FIGS. 4 and 5, it may be efficiently packed with many items of merchandise, as indicated by the numerals 38, 40, 42, 44, 46 and 48. Also there are times when return shipments to a distribution service center or shipments between retail stores will be smaller. The merchandise then may be well contained within the container assembly 30 in its reduced volume configuration, as illustrated in FIG. 6, where the merchandise is indicated by numbers 50 and 52. The volume changing pivotal flaps and the integral partial liner are folded and compressed within the container assembly 30, yet the expanded volume configuration may be formed quickly when once again it is needed.

How the Merchandise Contents of the Shipping-Transfer Container are Accounted for When Shipments and Transfers Occur At a merchandise service center, for example, a container assembly 30 is removed from its temporary storage space and arranged, in most instances, into its expanded volume configuration. This is undertaken, by first lifting off the top subassembly 32, then raising the volume changing pivotal flaps 64, 66, 68, 70 of the bottom subassembly 34 into their upright positions, as indicated in FIG. 3, extending upwardly from the bottom sides 136, 138, 140, 142. Then with respect to the integral partial liner 55, its respective strengthening flaps 56, 58, 60 and 62 are rotated away from erected flaps 66 and 70 along their common scores, to support and reinforce erected side flaps 64 and 68. The container is now in the expanded configuration, with security seal receiving holes 78 and 80 in the volume changing side flaps aligned respectively with seal receiving holes 150, 158 and 152, 156 in the pivotal, reinforcing flaps.

At this time, merchandise is packed into the bottom subassembly 34. A data recording document identifying the respective items of merchandise is prepared and given a code number corresponding to like numbers on a pair of deburred loopable metal seals 72 or plastic seals. The original document or a copy thereof is placed within the loaded bottom subassembly 34. Then the top subassembly 32 is placed over the expanded bottom subassembly 34. Also alternately or in addition the document or a copy thereof may be placed in a protective enclosure which is secured to the outside of the container.

Loopable Coded Security Seals

Thereafter, the respective like coded seals 72, such as illustrated in FIGS. 1, 2, 7 and 8, are respectively looped and guided through seal receiving holes, which as necessary, may be fitted with grommets 71. One coded seal 72 passes down through receiving hole 76 in the top assembly 32, extending through holes 152, 156 of the partial integral liner that reenforces the upstanding volume changing flap 68, and continuing on through the holes 82, 84 of the infolded side flaps 88, 132 of the top 32. The other coded seal 72 passes down through receiving hole 74 in the top assembly 32, extending through holes 150, 158 of the partial integral liner that reenforces the upstanding volume changing flap 64, and continuing on through the holes 81, 83 of the infolded side flaps 86, 130 of the top 32. The separate ends of these paired loopable security seals are then secured by their locking portions 94.

Then the expanded volume container assembly 30, as security sealed and coded, for example, is positioned with other containers, which preferably are also sealed shipping and transfer container assemblies 30, and moved on a cart and/or a conveyor to a vehicle loading station for shipment to a retail store. Upon arrival at the retail store the seals are observed to ascertain any damage. If there is damage it is immediately reported. Also when the container assemblies 30 are unpacked, the merchandise removed is checked and compared with the data on the coded recording document. If there are discrepancies, they are immediately reported. If any seal damage has occurred and/or any merchandise is missing, an investigation is undertaken as quickly as possible, to determine where and how the container assembly 30 and its merchandise has been mishandled. Also when merchandise is sent from retail store to retail store, for example to fill in missing sizes in a stock on hand, or when unsold merchandise is returned to the service center, often in reduced volume configurations of the container assembly 30, the same documenting and sealing procedures are preferably undertaken.

Surrounding Tensioned Sealed Straps

As shown in U.S. Pat. No. 3,917,154, sealing straps 96 may be used also in reference to this interstore transfer container 30. Their use is suggested in FIG. 1, phantom lines indicating where they would be placed, in lieu of the coded seals 72, when strapping machines are readily available.

Toe and Toe Slot Infolded Flaps of Top Subassembly

As illustrated in FIG. 10, to enhance the strength of the top subassembly 32, and consequently the overall strength of the container assembly 30, die cuts 102 are made during the manufacture of the top subassembly 32, and also toes 104 are formed on the infolded side flaps 86, 88 and on the infolded end flaps 106, 108 of ends 110, 112. Then upon assembly of the top subassembly 32 the toes 104 are securely fitted into the die cuts 102, firmly positioning and holding the infolded side flaps 86, 88 to the sides 90, 92 and holding the infolded end flaps 106, 108 to the ends 110, 112.

Strategic Placement of Strong Anti-Tear Tapes to Withstand Rough Handling and Attempted Security Seal Interference As indicated by closely spaced dotted lines or by solid closely spaced lines where an outer paperboard has been broken away for illustrative purposes in FIGS. 9 and 10, strips of strong antitear tapes 122 are strategically placed to withstand rough handling and attempted security seal interference and like purposes, resulting in longer reusable periods for these interstore transfer container assemblies 30. Their incorporation into the container assembly 30 is undertaken when the respective top subassemblies 32 and bottom subassemblies 34 are being manufactured. As shown in FIGS. 9 and 10, continuous strips of antitear tapes 122 are located just inside the outside layer 124 and adjacent the flutes 126, wherever they are placed.

Their placement is undertaken, wherever the antitear tapes 122 will be helpful in stopping tears and distortions of the paperboard materials comprising these corrugated container assemblies 30. The antitear tapes 122 are composed of nylon filaments bonded together in strips which are 3/16 or ⅜ inches wide, depending on the anticipated forces to be resisted. Generally longer container assemblies include ⅜ wide antitear tapes 122.

In FIG. 10 the placement of antitear tapes 122 are illustrated with respect to the top subassembly 32. There are four antitear strips 122 used, two being used in each side 90, 92 and continuing directly on through the respective fold flaps 128, 130, 132, 134. Therefore when the top subassembly 32 is being converted from its manufactured planar form, illustrated in FIG. 10, into its use form, as indicated in FIG. 4, the folding in of these fold flaps 128, 130, 132, 134 has the beneficial effect of carrying the antitear tapes or strips 122 around all the respective corners of the top subassembly 32.

In FIG. 9, the placement of antitear tapes 122 are illustrated with respect to the bottom subassembly 34. There are four antitear tapes or strips 122 used. During manufacture of the planar form, illustrated in FIG. 9, two antitear tapes 122 are drawn into the forming paperboard composite assembly throughout all the bottom sides 136, 138 and foldable strengthening flaps 56, 58, 60 and 62 of the integral partial liner 55, during production machine operating, and other antitear tapes 122 are drawn into the forming paperboard composite assembly throughout all the volume changing pivotal flaps 64 and 68, and the foldable strengthening flaps 56, 58, 60, 62 of the integral partial liner 55.

These selected placements of antitear tapes 122 in both the top subassembly 32 and bottom subassembly 34 of overall container assembly 30 are directed to avoiding excessive strains and/or tearing at corners and edges. Also very importantly these antitear tapes 122 are placed to avoid excessive strains and/or tearing at security seal receiving holes 78, 80, 83, 84, 160 and 162. Normally the antitear tapes are 3/16 or ⅜ inches wide; however, on larger containers, even wider ones will be used, such as ¾ inch or wider.

Integral Partial Liner

In this container 30, which is generally used in making interstore transfers, the integral partial liner 55 substantially doubles the strength of the overall longer side walls, and provides vertical strength for the entire container 30. However, this liner 55 does not increase the overall strength of the shorter end walls. Preferably, therefore, when a customer selects this container 30 rather than the container 30 illustrated in U.S. Pat. No. 3,917,154 he will do so for smaller size containers and with the understanding the comparative overall strengths especially at the ends are less than when a full four sided liner 36 is used. Forced entry along the longer side walls is effectively deterred. An attempted forced entry along the shorter end walls is likewise deterred, but if accomplished, sufficient distortion will remain resulting in the intended receiver of this interstore transfer container 30 to notice that a wrongful entry was attempted. He or she will then commence an investigation leading to the successful finding of the wrongdoer.

This integral partial liner 55 is always ready to serve its function in the expanded volume configuration of this interstore transfer container 30. Moreover it is always protected by the balance of the container and it therefore stays clean. Its folding down is also conveniently undertaken.

During the initial manufacture of this interstore transfer container 30, this integral partial liner 55 is economically made at the same time the bottom assembly 34 is produced, as indicated in FIG. 9. This initial savings in overall production costs is later supplemented by additional savings in handling costs, as a separate liner does not have to be accounted for and cared for during distribution of the interstore transfer container.

Aligned Finger Receiving Means for Applying Lifting Forces More Thoroughly to the Overall Container When personnel lift this interstore transfer container 30 in its expanded volume configuration their fingers grip both the top and bottom subassemblies 32, 34 for there are aligned finger gripping holes as illustrated in FIGS. 1, 3, 4, 9 and 10. When the container 30 is in its reduced volume configuration and the weight to be lifted is less, the personnel apply the lifting forces by finger gripping only the top assembly 32.

As shown in FIGS. 4 and 9, the finger gripping holes 144, 146 are respectively formed in the ultimately upstanding volume increasing end flaps 70, 66. As shown in FIG. 10, the finger gripping holes 166, 168, 170, 172 are respectively formed in the ultimately dual folded over depending flaps 106, 110, 112, 108 of the cover subassembly 10.

SUMMARY OF ADVANTAGES

These illustrated and described embodiments of container assemblies directed to shipping and transferring goods which are always fully accounted for and kept in excellent condition, accomplish this overall purpose and yet may be used over and over again for many shipments and transfers. If the user always keeps the components together and keeps the container assemblies covered when not in use, each container remains a clean container inside throughout its long period of use and it is ever ready to be expanded to a larger volume without hunting around for other components. Moreover, if the coded seals and coded documents are actively and properly relied upon pilferage will be substantially eliminated.

Yet all these advantages are obtained at comparatively low cost when, as preferred, the container assemblies are manufactured from paperboard materials by operating production machinery used in manufacturing corrugated containers of all types. Preferably as shown in FIG. 9, the bottom subassembly will have a one-piece, continuous bottom structure, to strengthen the overall structure, to keep the interior of the box clean, and to keep loose items from falling through as they are known to do when a less expensive R.S.C. bottom structure, meaning regular slotted container, is used.

As now improved with better securement and strategic placements of antitear tapes to withstand tougher handling, heavier loading, and attempted security seal infringements, these container assemblies further increase the following benefits stated once again:

1. coded and accountable sealed security in one of two selectable volumes;
2. extended periods of reusability while remaining clean inside;
3. space saving collapsibility for smaller shipments and storage;
4. reduced labor requirements in packaging and handling;
5. size range options of different embodiments;
6. maximum use of vehicle cargo spaces;
7. lightweight handling conveniences;
8. utilization of standard tooling and equipment; and
9. realization of savings as losses caused by pilferage and damage are substantially reduced often becoming very minimal.

I claim:

1. A container assembly reusable for many shipments and transfers, arrangeable either in an expanded volume configuration or alternately in a reduced volume configuration, comprising:

a. a cover subassembly having: a planar top surface structure and depending flaps forming a lid; and reinforcing antitear means for these depending flaps, thereby making this cover subassembly more resistant to rough handling; and b. a bottom subassembly, having a planar, one piece bottom surface; four upstanding sides which pivot upwardly from the bottom surface along their respective common scores; each score being common to a side of the bottom and the bottom edge of an upstanding side; volume changing flaps which pivot along the upstanding sides along their common scores, each score being common to the top edge of an upstanding side and to the bottom of a volume changing flap; additional volume changing structure, pivoting and unfolding from two opposite volume changing flaps to supplement the strength of the container, the pivoting occurring along their common scores, each score being common to one eventually upright side of an additional volume changing flap and to an eventually upright side of an additional volume changing structure; and reinforcing antitear means for the volume changing flaps thereby making this bottom subassembly more resistant to rough handling.

2. A container assembly reusable for many shipments and transfers, as claimed in claim 1, wherein the reinforcing antitear means is composed of strips of nylon filaments.

3. A container assembly reusable for many shipments and transfers, as claimed in claim 1, wherein the bottom subassembly and the cover subassembly are each manufactured as one piece rectangular structures from which the complete subassembly may be formed by folding the container along score lines.

4. A container assembly reusable for many shipments and transfers, as claimed in claim 1, comprising, in addition, tamper proof seal receiving means in both the cover and bottom subassemblies.

5. A container assembly reusable for many shipments and transfers, as claimed in claim 4, comprising, in addition, loopable tamper proof seals for placement through the tamper proof seal receiving means of both the cover and bottom subassemblies.

6. A container assembly reusable for many shipments and transfers, as claimed in claim 2, comprising, in addition, security tamper proof completely surrounding tensioned and sealed straps.

7. A container assembly reusable for many two way shipments and transfers, while security sealed and preferably with a transfer document enclosed within the sealed volume, arrangeable either in an expanded volume configuration, or alternately in a reduced volume configuration, often being used to transfer goods between department store service centers and respective retail stores, comprising:

a. a one piece rectangular box-like structure, folded along score lines to form a cover subassembly, having: a planar top surface and depending flaps forming a lid; tamper proof seal receiving means; and reinforcing antitear means for these depending flaps, thereby making the flaps and the seal receiving means more resistant to rough handling and to attempted security seal interference; and b. a one piece rectangular box-like structure, folded along score lines to form a bottom subassembly, having: a planar bottom surface; four upstanding sides which pivot upwardly from the bottom surface along their common scores; volume changing flaps which pivot along the upstanding sides along their common scores, each score being common to the top each of an upstanding side and to the bottom of a volume changing flap; additional volume changing structure unfolded from two opposite volume changing flaps along common scores to supplement the strength of the container each score being common to one eventually upright side of an additional volume changing flap and to an eventually upright side of an additional volume changing structure; tamper proof seal receiving means; and reinforcing antitear means for the volume changing flaps, and for the upstanding sides thereby making the flaps, sides, and the seal receiving means more resistant to rough handling and to attempted security seal interference.

8. A container assembly reusable for many two way shipments and transfers, while security sealed, as claimed in claim 7, wherein the tamper proof receiving means in both the cover and bottom subassemblies are respective spaced holes.

9. A container assembly reusable for many two way shipments and transfers, while security sealed, as claimed in claim 8 having, in addition, loopable tamper proof seals for placement through the respective spaced holes.

10. A corrugated container assembly reusable for multiple two way shipments and transfers, preferably while security sealed with an accountability transfer document enclosed, and arranged either in an expanded volume configuration, or alternatively in a reduced volume configuration, often being transferred between department store service centers and respective retail stores, comprising:

a. a one piece, rectangular box-like, corrugated structure, folded along score lines to form a cover subassembly, having: a planar top surface and depending dual flaps to be folded over one another forming a lid; tamper proof seal receiving means; and reinforcing antitear means for the dual flaps, thereby making the dual flaps and the seal receiving means more resistant to rough handling and to attempted security seal interference; and b. a one piece, rectangular box-like, corrugated structure, folded along score lines to form a bottom subassembly, having: a planar bottom surface; upstanding sides which pivot upwardly from the bottom surface along their common scores; four volume changing flaps which pivot along the upstanding sides along their common scores, each score being common to the top edge of an upstanding side and to the bottom of a volume changing flap; additional volume changing structure unfolded from two opposite volume changing flaps along common scores forming an integral partial liner to supplement the strength of the container in its expanded volume configuration each score being common to one eventually upright side of an additional volume changing flap and to an eventually upright side of an additional volume changing structure; tamper proof seal receiving means; and reinforcing antitear means for the volume changing flaps and the upstanding sides, thereby making the flaps, these sides, and the seal receiving means more resistant to rough handling and to attempted security seal interference.

11. A corrugated container assembly reusable for multiple two way shipments and transfers, as claimed in claim 10, wherein the tamper proof seal receiving means in both the cover and bottom subassemblies are respective spaced holes.

12. A corrugated container assembly reusable for multiple two way shipments and transfers, as claimed in claim 11, having, in addition, loopable tamper proof seals for placement through the respective spaced holes.

13. A corrugated container assembly reusable for multiple two way shipments and transfers, as claimed in claim 10, having, in addition, completely surrounding tensioned and sealed straps used in conjunction with the tamper proof seal receiving means.

14. A corrugated container assembly reusable for multiple two way shipments and transfers, as claimed in claim 10, wherein the reinforcing antitear means is composed of strips of nylon filaments.

15. A corrugated container assembly reusable for multiple two way shipments and transfers, as claimed in claim 14, wherein the strips of nylon filaments, serving as the antitear means, are placed during the container manufacturing process between the interior side of the outside face and the adjacent corrugations.

16. A corrugated container assembly reusable for multiple two way shipments and transfers, as claimed in claim 15, wherein the strips of nylon filaments serving as the antitear means are placed to distribute lifting loads and seal tampering forces.

17. A corrugated container assembly reusable for multiple two way shipments and transfers, as claimed in claim 10, wherein the corrugated cover subassembly comprises, in addition, dual corner infolded flap end portions pivotally and integrally made with the dual depending flaps forming a stronger corrugated cover subassembly.

18. A corrugated container assembly reusable for multiple two way shipments and transfers, as claimed in claim 17, wherein the corrugated cover subassembly includes interfitting respective toe projection and toe hole structures to removably secure the dual infolded flaps.

19. A corrugated container assembly reusable for multiple two way shipments and transfers, as claimed in claim 10, wherein the volume changing pivotal flaps have finger receiving means used to lift the corrugated container assembly.

20. A corrugated container assembly reusable for two way shipment transfers, as claimed in claim 10, wherein both the volume changing pivotal flaps of the bottom assembly and the dual flaps of the top assembly have aligned finger receiving means used during the lifting of the corrugated container assembly whereby the lifting forces are applied more thoroughly to the overall container.

* * * * *